US009044085B2

(12) United States Patent
Cunningham et al.

(10) Patent No.: US 9,044,085 B2
(45) Date of Patent: Jun. 2, 2015

(54) MODULAR FURNITURE AND METHOD

(76) Inventors: Kenny Vernon Cunningham, Wyandotte, OK (US); Andrea Yomara Pelaez-Cunningham, Wyandotte, OK (US)

( * ) Notice: Subject to any disclaimer, the term of this patent is extended or adjusted under 35 U.S.C. 154(b) by 322 days.

(21) Appl. No.: 13/485,271

(22) Filed: May 31, 2012

(65) Prior Publication Data

US 2013/0320718 A1 Dec. 5, 2013

(51) Int. Cl.

| | |
|---|---|
| ***A47C 7/00*** | (2006.01) |
| ***A47B 3/06*** | (2006.01) |
| ***A47C 3/029*** | (2006.01) |
| ***A47C 4/02*** | (2006.01) |
| ***A47C 7/70*** | (2006.01) |

(52) U.S. Cl.

CPC ..... *A47B 3/06* (2013.01); *Y10T 29/49826* (2015.01); *Y10T 29/53* (2015.01); *A47B 2230/0088* (2013.01); *A47B 2230/0092* (2013.01); *A47C 3/029* (2013.01); *A47C 4/021* (2013.01); *A47C 7/70* (2013.01)

(58) Field of Classification Search

CPC ..... A47C 4/021; A47C 5/005; A47B 2230/0085; A47B 2230/0092

USPC ..... 297/440.13, 451.8, 130; 108/157.16, 108/158.12

See application file for complete search history.

(56) References Cited

U.S. PATENT DOCUMENTS

| | | | | | |
|---|---|---|---|---|---|
| 2,279,864 | A | * | 4/1942 | Eide | 211/189 |
| 2,334,912 | A | * | 11/1943 | Eide | 108/27 |
| 2,418,731 | A | | 4/1945 | Seitz | |
| 2,486,987 | A | * | 11/1949 | Scarlett | 297/440.13 |
| 3,347,610 | A | | 10/1967 | Pilliod | |
| 3,490,809 | A | * | 1/1970 | Lange | 297/440.13 |
| 3,788,700 | A | * | 1/1974 | Wartes | 297/440.13 |
| 3,874,753 | A | | 4/1975 | Naito et al. | |
| 4,140,065 | A | | 2/1979 | Chacon | |
| 4,419,028 | A | * | 12/1983 | Roland | 403/353 |
| 4,509,794 | A | * | 4/1985 | Roland | 297/440.13 |
| 4,593,950 | A | | 6/1986 | Infanti | |
| 4,867,327 | A | * | 9/1989 | Roland | 217/12 R |
| 4,886,326 | A | | 12/1989 | Kuzyk | |
| 5,000,514 | A | * | 3/1991 | Hanson | 297/440.13 |
| 5,082,329 | A | * | 1/1992 | Mars | 297/440.13 |
| 5,263,766 | A | * | 11/1993 | McCullough | 297/440.13 |
| 5,423,597 | A | | 6/1995 | Rogers | |
| 5,762,530 | A | * | 6/1998 | Zheng | 446/114 |

(Continued)

FOREIGN PATENT DOCUMENTS

| | | | | | |
|---|---|---|---|---|---|
| GB | 2411707 | A | * | 9/2005 | F16B 12/00 |

*Primary Examiner* — David R Dunn
*Assistant Examiner* — Tania Abraham
(74) *Attorney, Agent, or Firm* — Martin & Associates, LLC; Derek P. Martin

(57) ABSTRACT

Modular furniture includes several members connected together without fasteners or other hardware. While some of the members slide together, some members are locked in place by other members. The modular furniture includes one or more members that engage other members in a twist and lock fashion that helps hold the modular furniture together during everyday use. The twist and lock may be achieved using a substantially L-shaped slot in one member and a corresponding slot in a mating member, which allows the mating member to rotate (twist) within the L-shaped slot. The modular furniture is locked together at several different members and stages of assembly, and includes a final stop member that assures the furniture cannot come apart inadvertently during normal use.

19 Claims, 6 Drawing Sheets

(56) References Cited

U.S. PATENT DOCUMENTS

| | | | | | |
|---|---|---|---|---|---|
| 5,803,548 | A * | 9/1998 | Battle | 297/440.13 |
| 5,806,922 | A * | 9/1998 | Mendelovich | 297/130 |
| 5,921,631 | A * | 7/1999 | Bush | 297/440.1 |
| 6,089,654 | A * | 7/2000 | Burstein | 297/151 |
| 6,688,699 | B1 | 2/2004 | Bowie | |
| 7,044,557 | B2 | 5/2006 | Wieland | |
| 7,168,766 | B2 * | 1/2007 | Pelletier | 297/440.13 |
| 7,300,110 | B1 * | 11/2007 | Debien | 297/440.13 |
| 2006/0162268 | A1 * | 7/2006 | Eberlein et al. | 52/236.9 |
| 2009/0066140 | A1 * | 3/2009 | Berent et al. | 297/440.13 |
| 2011/0074186 | A1 * | 3/2011 | Zhong | 297/130 |

* cited by examiner

MODULAR FURNITURE AND METHOD

BACKGROUND

1. Technical Field

This disclosure generally relates to furniture, and more specifically relates to modular furniture that is assembled without fasteners or other hardware.

2. Background Art

Various different types of modular furniture have been around for decades. Modular furniture allows the furniture to be shipped in relatively flat boxes, and is typically assembled by the purchaser. Different types of modular furniture include a variety of different systems that use a variety of different fasteners and other hardware to interconnect pieces of the modular furniture. For example, in well-known modular office furniture made of particle board covered by laminate, metal circular pieces are placed within cylindrical recesses in one piece, a metal stud is screwed into a mating piece, the two pieces are brought in proximity to each other such that the metal stud is placed within the metal circular piece, and the metal circular piece is then rotated to captivate the metal stud within the metal circular piece, effectively joining the two pieces together. Other types of modular furniture, such as bookshelves, may be assembled without fasteners by simply sliding the slots of mating pieces together. While this may be an acceptable design for some static pieces such as bookshelves that do not move, this design would be unsuitable for many furniture pieces that are moved during everyday use, such as tables or chairs, due to the risk of the pieces sliding apart during normal use.

BRIEF SUMMARY

Modular furniture includes several members connected together without fasteners or other hardware. While some of the members slide together, some members are locked in place by other members. The modular furniture includes one or more members that engage other members in a twist and lock fashion that helps hold the modular furniture together during everyday use. The twist and lock may be achieved using a substantially L-shaped slot in one member and a corresponding slot in a mating member, which allows the mating member to rotate (twist) within the L-shaped slot. The modular furniture is locked together at several different members and stages of assembly, and includes a final stop member that assures the furniture cannot come apart inadvertently during normal use.

The foregoing and other features and advantages will be apparent from the following more particular description, as illustrated in the accompanying drawings.

BRIEF DESCRIPTION OF THE SEVERAL VIEWS OF THE DRAWING(S)

The disclosure will be described in conjunction with the appended drawings, where like designations denote like elements, and:

DETAILED DESCRIPTION

Modular furniture includes several members connected together without fasteners or other hardware. While some of the members slide together, some members are locked in place by other members. The modular furniture includes one or more members that engage other members in a twist and lock fashion that helps hold the modular furniture together during everyday use. The twist and lock may be achieved using a substantially L-shaped slot in one member and a corresponding slot in a mating member, which allows the mating member to rotate (twist) within the L-shaped slot. The modular furniture is locked together at several different members and stages of assembly, and includes a final stop member that assures the furniture cannot come apart inadvertently during normal use.

Figure 1:
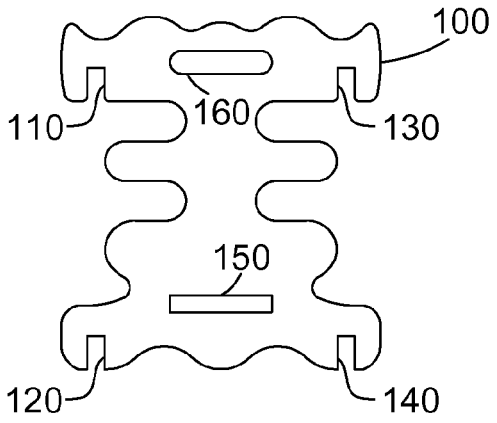
FIG. 1 is a front view of a back member for a modular chair.
Figure 2:
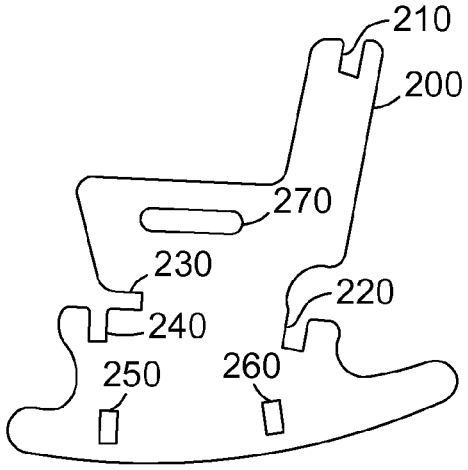
FIG. 2 is a side view of a side member for the modular chair.

FIGS. 1-32 show various view of a modular chair, while FIGS. 33-37 show members for a modular table. The modular chair has a back member. One suitable example of a back member is shown as 100 in FIG. 1. The back member 100 includes a left upper slot 110, a left lower slot 120, a right upper slot 130, a right lower slot 140, a seat slot 150, and may optionally include a slot 160 that may be used as a carrying handle. The modular chair also includes two side members. One suitable example of a side member is shown in FIG. 2. In the implementation shown in FIG. 2, side member 200 represents both a right side member and a left side member. Side member 200 includes an upper slot 210, a lower slot 220, an upper front slot 230, a lower front slot 240, and leg slots 250 and 260. Side member 200 in FIG. 2 is also shown with a slot 270 that may be used to lift and carry the side member 200 or the assembled chair.

Figure 3:
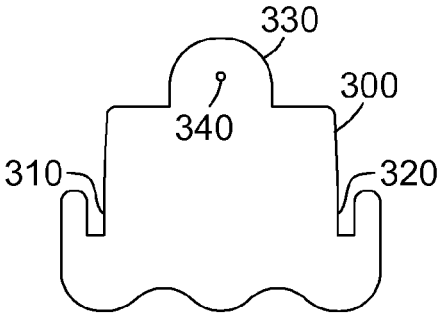
FIG. 3 is a top view of a seat member for the modular chair.
Figure 4:
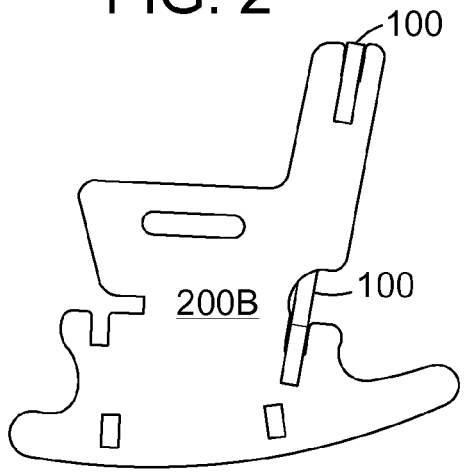
FIG. 4 is a side view showing the side member in FIG. 2 assembled to the back member in FIG. 1.

The modular chair also includes a seat member. One suitable example of a seat member is shown in FIG. 3. The seat member 300 includes two slots 310 and 320, and a rear tab 330 that includes a hole 340. Assembly of the modular chair begins by taking a left side member 200A, identical to the side member 200 in FIG. 2, and sliding the left upper slot 110 of the back member 100 into the upper slot 210 of the left side member 200A while simultaneously sliding the left lower slot 120 of the back member 100 into the lower slot 220 of the left side member 200A. The same process is repeated to connect the back member 100 to a right side member 200B, identical to the side member 200 in FIG. 2, by sliding the right upper slot 130 of the back member 100 into the upper slot 210 of the right side member 200B while simultaneously sliding the right lower slot 140 of the back member 100 into the lower slot 220 of the right side member 200B. A right side view of the back member 100 assembled to the right side member 200B is shown in FIG. 4. A front view of the back member 100 assembled to both left side member 200A and right side member 200B is shown in FIG. 5.

Figure 5:
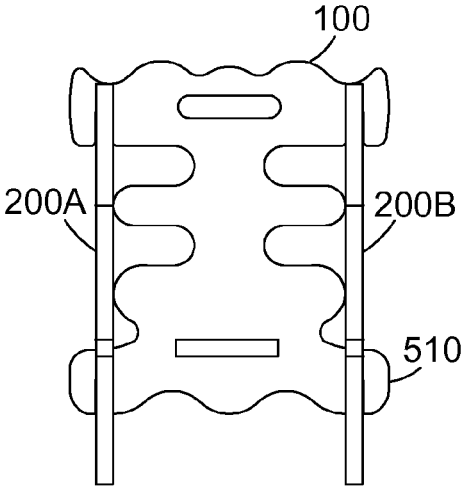
FIG. 5 is a front view showing two side members as shown in FIG. 2 assembled to the back member in FIG. 1.
Figure 6:
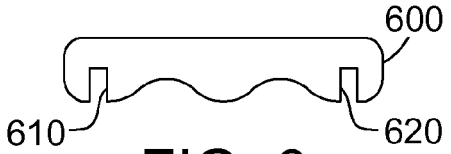
FIG. 6 is a front view of a front member for the modular chair.
Figure 7:
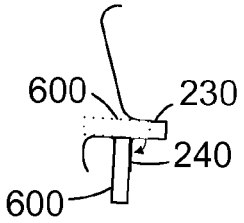
FIG. 7 is a side view illustrating the installation of the front member in FIG. 6 into the side member in FIG. 4.
Figure 8:
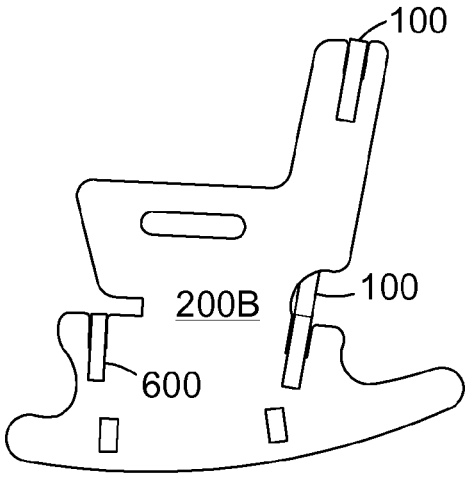
FIG. 8 is a side view of the modular chair after installation of the front member shown in FIG. 6.

Once the side members are assembled to the back member as shown in FIG. 5, a front member 600 as shown in FIG. 6 may be installed in the lower front slots 240 (FIG. 2) of each side member. The front member 600 includes slots 610 and 620 that are spaced to line up with the side members 200A and 200B when the side members 200A and 200B are assembled to the back member 100. The front member 600 is attached to the side members 200A and 200B in what is referred to herein as a "twist and lock" motion. This twist and lock motion is illustrated in FIG. 7, where the front member 600 is brought into a substantially horizontal position as shown in phantom in FIG. 7, where the slots 610 and 620 align with the upper slots 230 on the side members 200A and 200B. As the front member 600 is pushed towards the upper slots 230, it is also rotated until the front member 600 engages the lower slots 240, as shown by the front member 600 shown in solid lines in FIG. 7. The front member 600 is thus installed by twisting the front member approximately ninety degrees from a substantially horizontal orientation to a substantially vertical orientation, as illustrated in FIG. 7. The modular chair with the back member 100, two side members 200A and 200B, and front member 600 assembled together is shown in the right side view in FIG. 8 and in the front view in FIG. 9.

Figure 9:
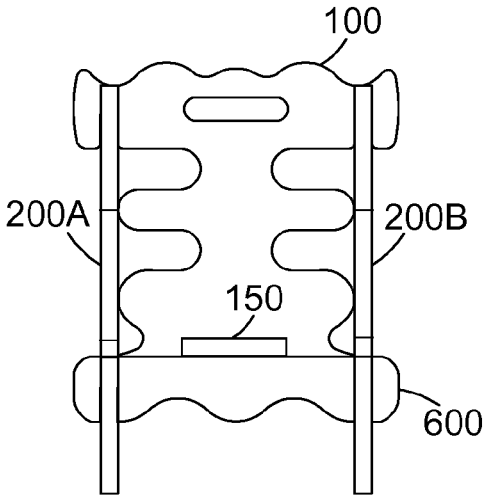
FIG. 9 is a front view of the modular chair in FIG. 8.
Figure 10:
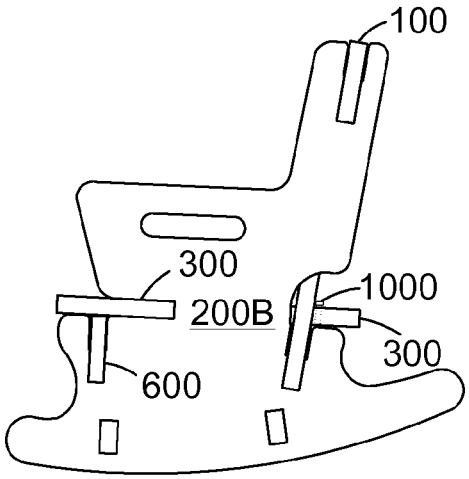
FIG. 10 is a side view of the modular chair after installation of the seat member shown in FIG. 3.

Once the front member 600 is in place as shown in FIG. 9, the seat member 300 in FIG. 3 is slid on top of the front member 600 towards the back member 100 until the tab 330 on the seat member 300 extends through the seat slot 150, and the left slot 310 of the seat member 300 engages the upper front slot 230 of the left side member 200A while simultaneously the right slot 320 of the seat member 300 engages the upper front slot 230 of the right side member 200B. Once the seat member 300 is in place, a stop member such as a wooden peg 1000 shown in FIG. 10 is placed within the hole 340 and extends above the seat member 300, captivating the tab 330 of the seat member 300 within the seat slot 150 of the back member 100. Because the seat member 300 is placed on top of the front member 600, captivating the seat member to the back member results in the front member 600 being captivated as well. The result is a modular chair that is very easily assembled and disassembled, but does not risk inadvertent disassembly because of the stop member 1000 effectively keeping all of the members locked together.

Figure 29:
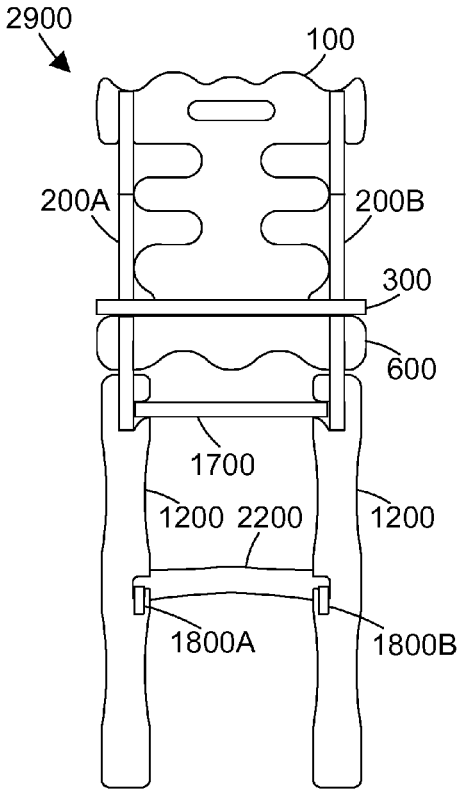
FIG. 29 is a front view of the modular chair with the legs and three locking members installed.

Because the side members 200 have a curved bottom surface, the assembled modular chair may be used as a rocking chair. The modular chair could have dimensions that make it suitable for small children, such as toddlers. The modular chair is flexible because it can be used as a rocking chair in the configuration shown in FIGS. 10 and 11. With the addition of legs, a footrest, and a tray, the modular chair can be used as a high chair as well, as shown in FIG. 29 and discussed in detail below.

Figure 12:
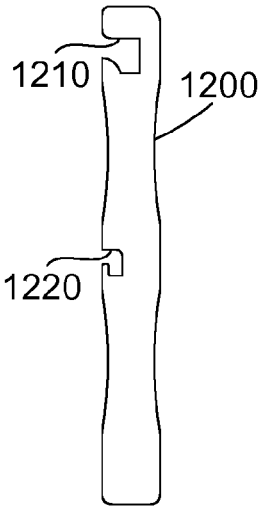
FIG. 12 is a front view of a leg member.

Referring to FIG. 12, a leg 1200 includes a first substantially L-shaped slot 1210 and a second substantially L-shaped slot 1220. The first slot 1210 is used to connect each leg to one of the side members. The second slot 1220 is to connect two of the legs together with a locking member as described in more detail below.

Figure 13:
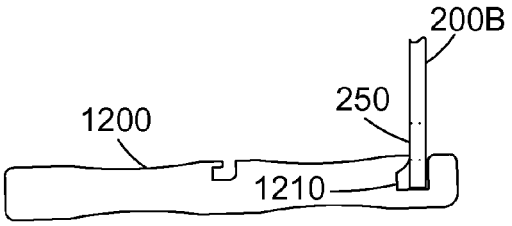
FIG. 13 is a front view of the leg member in FIG. 12 illustrating a first position when installing the leg member to a side member.
Figure 14:
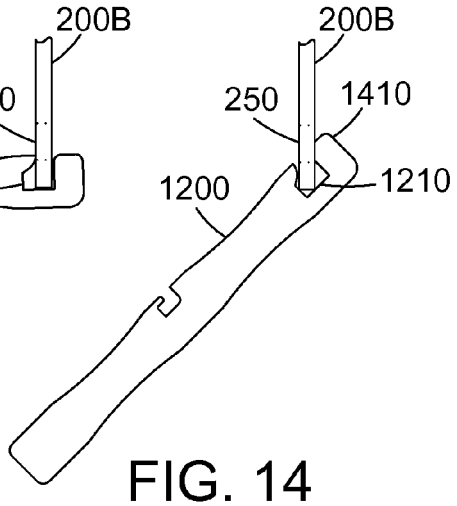
FIG. 14 is a front view of the leg member in FIG. 12 illustrating a second position when installing the leg member to a side member.
Figure 15:
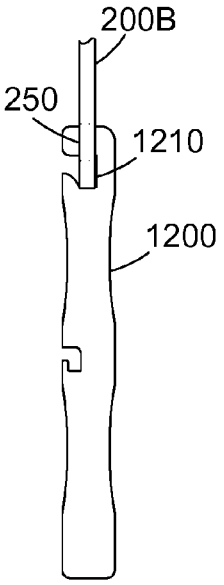
FIG. 15 is a front view of the leg member in FIG. 12 illustrating a third and final position when installing the leg member to a side member.
Figure 16:
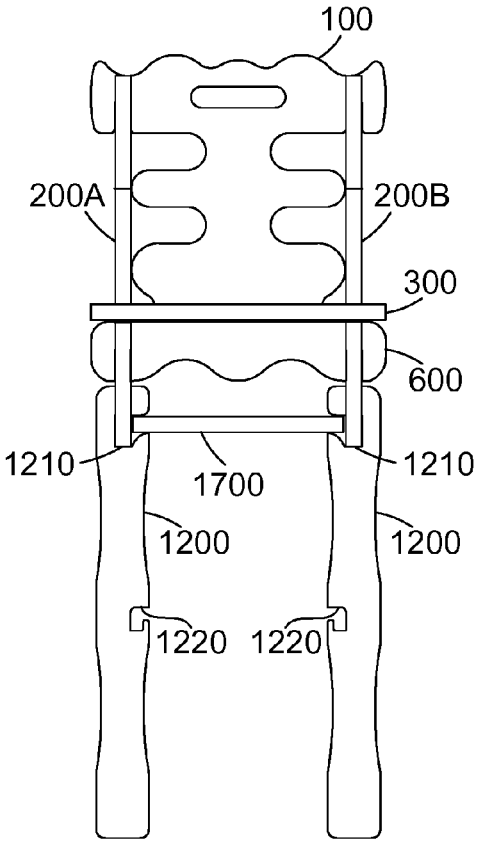
FIG. 16 is a front view of the modular chair with legs attached and a footrest as shown in FIG. 17 installed.

Referring to FIG. 13, the installation of leg 1200 into one of the leg slots on the right side piece 200B is shown by way of example. The lower part of the right side member 200B is shown in the same orientation as the right side member 200B shown in FIG. 5. The first slot 1210 of leg 1200 is positioned so the bottom of the right side piece 200B is within the slot 1210 as shown in FIG. 13, with the leg 1200 aligned with one of the leg slots 250 and 260. We assume for this example the leg is being installed in leg slot 250 in right side member 200B. With the leg 1200 positioned as shown in FIG. 13 and aligned with the leg slot 250 in the right side member 200B, the leg is rotated as shown in FIG. 14 so the top portion 1410 slides in the leg slot 250. Rotation of the leg is continued until the position shown in FIG. 15, at which point the side of the slot 1210 prevents the leg 1200 for rotating further. The second leg is then installed in the slot 260 of the right side member 200B in similar fashion, followed by the installation of the third and fourth legs into the leg slots 250 and 260 in the left side member 200A. The resulting modular chair is shown in FIG. 16. The first substantially L-shaped slot 1210 on each leg allows the leg to be installed in a twist and lock fashion, as shown in FIGS. 13-15.

Figure 17:
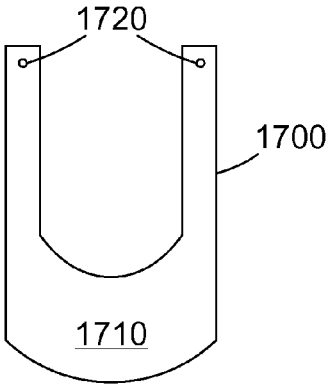
FIG. 17 is a top view of a footrest shown in FIG. 16.

A foot rest 1700 is shown in FIG. 17, and is dimensioned to slide within the edges of the first slots 1210 of all four legs 1200 as shown in FIG. 16. Note the foot rest 1700, once installed into the slots 1210 as shown in FIG. 16, prevents the legs 1200 from pivoting, thereby securing the legs to the side members 200A and 200B. The foot rest 1700 provides a surface 1710 on which a child may rest his or her feet while in the modular chair. The foot rest may optionally include holes 1720 as shown in FIG. 17 through which stop members such as pegs may be placed to prevent the foot rest 1720 from sliding forward after the foot rest 1700 is installed in the first slots 1210 of all four legs 1200.

Figure 18:
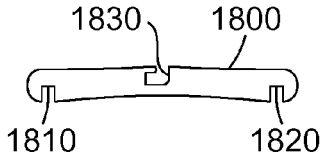
FIG. 18 is a side view of a locking member.
Figure 19:
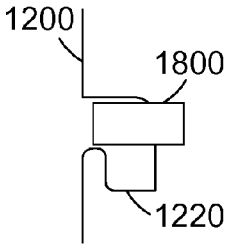
FIG. 19 is a side view showing a first position for the locking member 1800 in FIG. 18.
Figure 20:
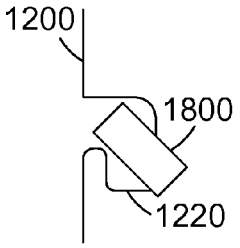
FIG. 20 is a side view showing a second position for the locking member 1800 in FIG. 18.
Figure 21:
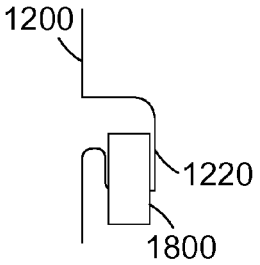
FIG. 21 is a side view showing a third and final position for the locking member 1800 in FIG. 18 that locks together a pair of legs 1200 using a twist and lock motion illustrated in FIGS. 19-21.
Figure 22:
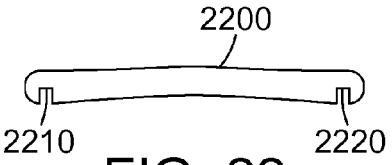
FIG. 22 is a side view of a third locking member.
Figure 23:
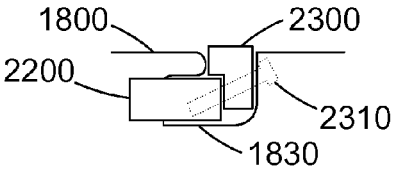
FIG. 23 is a side view showing a stop member that locks the third locking member shown in FIG. 22 into the L-shaped slots 1830 of first and second locking members and a stop device that locks the stop member to the third locking member.

The legs may be locked together with locking members, such as locking member 1800 shown in FIG. 18. Locking member 1800 includes two slots 1810 and 1820 that engage the second substantially L-shaped slots 1220 in two of the legs 1200. The locking member 1800 is installed using a twist and lock motion shown in FIGS. 19-21. The locking member 1800 is positioned so the slot 1810 aligns with the top portion of slot 1220, as shown in FIG. 19. The locking members 1800 is then rotated, as shown in FIG. 20 to the final position shown in FIG. 21. The final position shown in FIG. 21 for the locking member 1800 is approximately 90 degrees from the original position shown in FIG. 19. Two of the legs are locked together with the locking member 1800 using a twist and lock motion. The two legs attached to the opposite side member also have a locking member 1800 installed in similar fashion. Note the locking member 1800 also includes an L-shaped slot 1830, so once the two locking members 1800 are installed, one below the left side member and one below the right side member, a third locking member may be used to lock the two locking members 1800 together. Referring to FIG. 22, a third locking member 2200 includes slots 2210 and 2220 that align with the L-shaped slots 1830 on the two locking members 1800 after the locking members 1800 are attached to the legs 1200. Locking member 2200 is installed with a twist and lock motion, similar to that illustrated in FIGS. 19-21. The third locking member 2200 prevents the other two locking members 1800 from rotating (twisting), thereby locking them into place. After the third locking member 2200 is installed, a stop member 2300 may be installed to lock the locking member 2200 into place. The stop member 2300 preferably has an L-shaped cross section, and includes a hole through which a peg or other stop device 2310 may be installed to lock the stop member 2300 to the third locking member 2200. Note the stop device 2310 in FIG. 23 is a peg shown in phantom, and is preferably installed between the two slots 2210 and 2220. Once the stop device 2300 is secured to the third locking member 2200 using the stop device 2310 as shown in FIG. 23, the entire chair is locked together to avoid unintentional disassembly.

Figure 24:
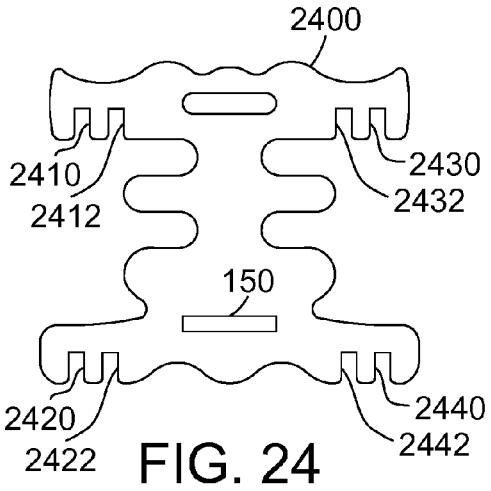
FIG. 24 is a front view of an alternative implementation for the back member shown in FIG. 1 that allows constructing a modular chair in three different widths.

The modular chair herein may have a number of different configurations and uses. FIG. 24 shows a back member 2400 that includes first and second left upper slots 2410 and 2412, first and second left lower slots 2420 and 2422, first and second right upper slots 2430 and 2432, and first and second right lower slots 2440 and 2442 as shown. With this configuration for the back and corresponding configurations for the front member and seat member (e.g., see FIG. 25), the modular chair could be constructed to be three different widths: 1) narrow, with the side members installed in the inside sets of slots; 2) wide, with the side members installed in the outside sets of slots; and 3) intermediate, with one side member installed in the inner set of slots while the opposing side member is installed in the outer set of slots. This provides great flexibility by providing the capability of determining as the modular chair is put together the appropriate width of the modular chair.

Figure 25:
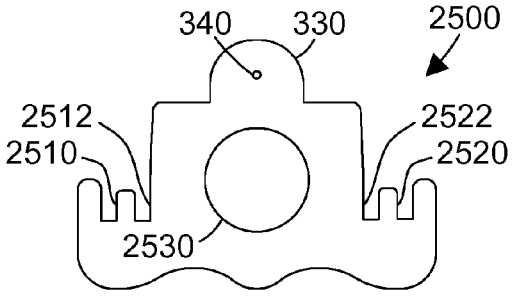
FIG. 25 is a top view of an alternative implementation for the seat member shown in FIG. 3 that allows constructing a modular chair in three different widths, and that also accommodates using the chair as a toilet training chair for a small child.

Referring to FIG. 25, a seat member 2500 is shown to include multiple slots 2510 and 2512 on the left side and multiple slots 2520 and 2522 on the right side. The seat member 2500 also includes a circular hole 2530 that allows the modular chair to be used as a toilet training chair for toddlers. The hole 2530 may have any suitable configuration to receive a receptacle, such as a plastic bowl. For example, the hole 2530 may include a recessed lip that catches the lip of a plastic bowl to hold the plastic bowl in place. A corresponding plug for the hole 2530 may also be provided so the chair may be used for seating a toddler when not being used for toilet training To accommodate the adjustable width illustrated in FIGS. 24 and 25, the front member 600 in FIG. 6 would also required two sets of slots. In addition, the foot rest 1700 in FIG. 17 would require extension pieces that could be added on each side, such as via dowel pins, to provide the three different widths.

Figure 11:
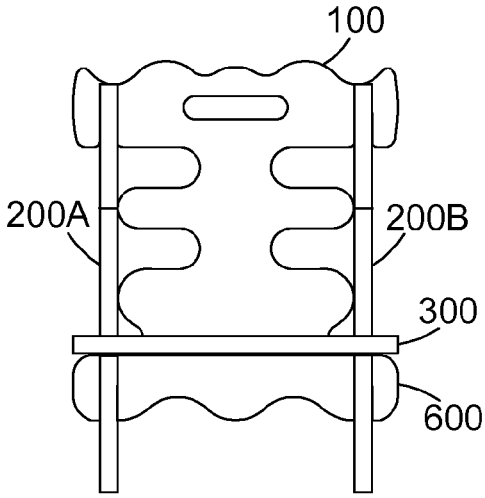
FIG. 11 is the front view of the modular chair in FIG. 10.
Figure 26:
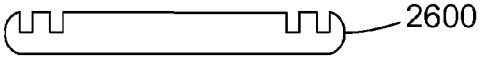
FIG. 26 is a side view of a first member for a base for the modular chair.
Figure 27:
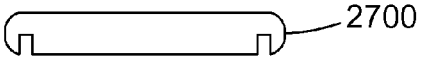
FIG. 27 is a side view of a second member for the base for the modular chair.
Figure 28:
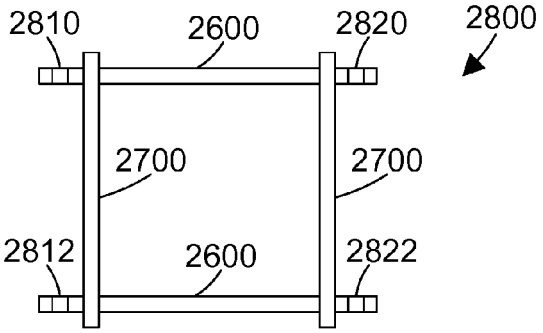
FIG. 28 is a top view of the base for the modular chair constructed from the members shown in FIGS. 26 and 27 that allows placing the modular chair into the base to prevent the modular chair from rocking.

Because the preferred configuration for the modular chair is a rocking chair as shown in FIGS. 10 and 11, a rocking chair is not the most desirable configuration when using the chair as a toilet training chair for obvious reasons. As a result, the modular chair may be placed in a base to keep the modular chair from rocking Such a base is described with reference to FIGS. 26-28. Two members 2600 as shown in FIG. 26 are placed with their slots facing upwards, and two members 2700 shown in FIG. 27 are placed in the inside set of slots in the two members 2600 as shown in FIG. 28. The result is a base 2800 that includes slots 2810 and 2812 that can receive the bottom of the left side member 200A, and slots 2820 and 2822 that can receive the bottom of the right side member 200B. The base 2800 thus provides a structure that prevents the modular chair from rocking when used for toilet training, or whenever the rocking action of the chair needs to be inhibited.

Figure 30:
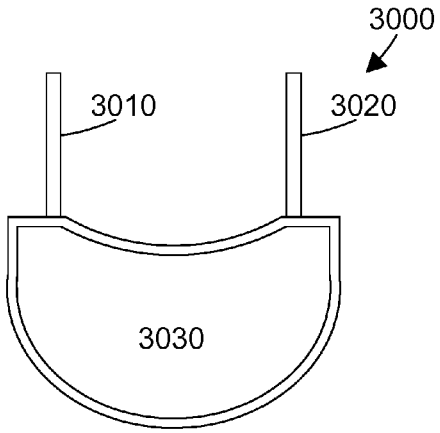
FIG. 30 is a top view of a tray for the modular chair.
Figure 31:
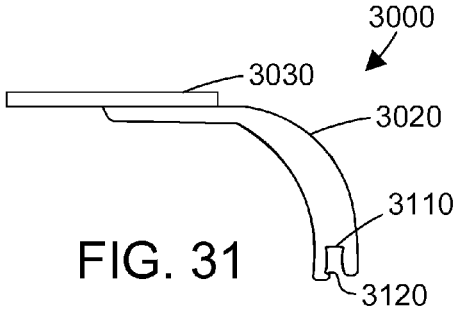
FIG. 31 is a side view of the tray in FIG. 30.
Figure 32:
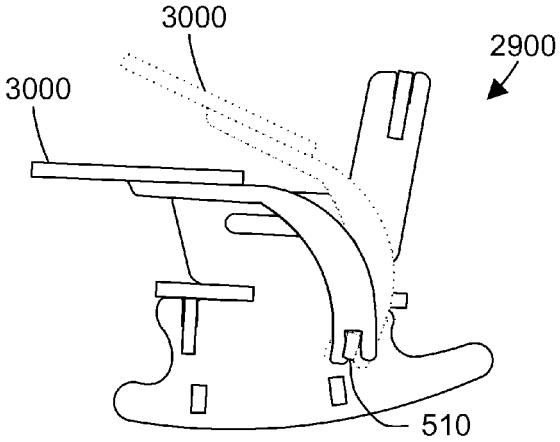
FIG. 32 is a side view showing installation of the tray onto the modular chair using a twist and lock motion.

The modular chair may be assembled to function as a high chair 2900 as shown in FIG. 29. Note the legs 1200 on each side are locked together using locking members 1800A and 1800B, which are each identical to locking member 1800 in FIG. 18, and the locking members 1800A and 1800B are locked together using locking member 2200. A top view of a suitable tray 3000 for the high chair is shown in FIG. 30, with the side view shown in FIG. 31. The tray 3000 includes a left support member 3010, a right support member 3020, and a top portion 3030. Each support member 3010 and 3020 includes a slot 3110 as shown in FIG. 31 that includes a lip 3120. The tray is installed on the modular chair in FIG. 29 as shown in the side view in FIG. 32. Note the legs have been omitted in FIG. 32 because they are not needed to illustrate how the tray attaches to the modular chair. The tray 3000 is positioned at an angle as shown in phantom in FIG. 32, with the slot 3110 in each support member 3010 and 3020 engaging a side portion of the back, shown as 510 in FIG. 5. The tray 3000 is then rotated so the bottom of the top portion rests on the side members, as shown in the solid lines in FIG. 32. In this position, the lip 3120 shown in FIG. 31 is disposed below the side member 510 as shown in FIG. 32, locking the tray 3000 into place. This is another example of a twist and lock motion to attach the tray to the modular chair.

Figure 33:
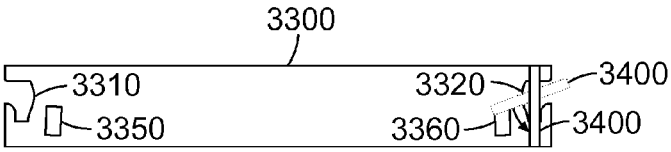
FIG. 33 is a side view of one suitable table member that includes substantially L-shaped slots.
Figure 34:
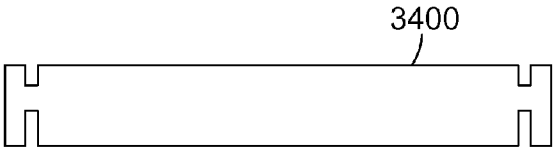
FIG. 34 is a side view of another suitable table member that is designed to twist and lock into table members as shown in FIG. 33.
Figure 35:
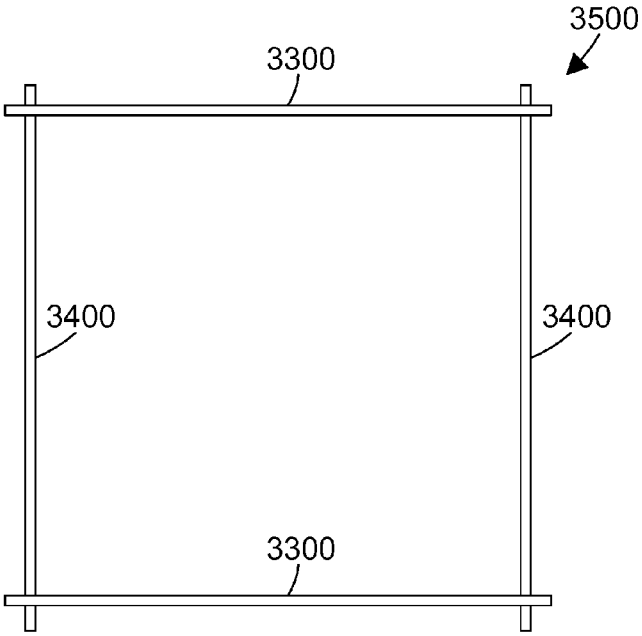
FIG. 35 is a top view showing two table members 3400 in FIG. 34 that have been assembled to two table members 3300 in FIG. 33 using a twist and lock motion.

The same twist and lock attachment shown in the modular chair could be used in other furniture as well. FIGS. 33-37 show structural members that could be used to assemble a base for a table. Two side pieces 3300 shown in FIG. 33 include substantially L-shaped slots, while two other side pieces 3400 shown in FIG. 34 include corresponding slots that allow the two side members 3400 to be installed into the two other side members 3300 using a twist and lock motion. This is shown in FIG. 33, where the end of member 3400 is positioned at an angle with respect to the L-shaped slot 3320, as shown in phantom in FIG. 33. The member 3400 is then rotated (twisted) as shown by the arrow in FIG. 33 to be in the correct orientation, as shown in solid lines in FIG. 33. The side pieces 3400 are thus attached to the other side pieces 3300 using a twist and lock motion to produce a structure 3500 as shown in FIG. 35. Note the side members 3300 include leg slots 3350 and 3360 that may receive legs similar to leg 1200 shown in FIG. 12. These table legs may be locked together using first and second locking members similar to locking member 1800 in FIG. 18, which may in turn be locked together using a third locking member similar to locking member 2200 in FIG. 22, as described in detail above. Note the slots 3350 and 3360 are shown in FIG. 33 to be close enough to the substantially L-shaped slots 3310 and 3320 that once the legs are installed into the slots 3350 and 3360, the legs keep the side members 3400 from rotating to disengage the side members 3300. The legs thus lock the side members 3300 and 3400 to each other once the legs are installed.

Figure 36:
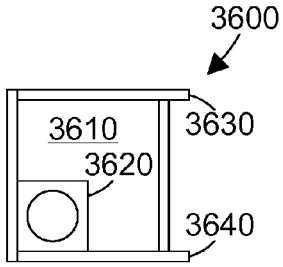
FIG. 36 is a top view of a table tray.
Figure 37:
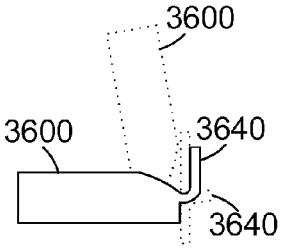
FIG. 37 is a side view of the table tray shown in FIG. 36.

Once the table structure 3500 shown in FIG. 35 is assembled and the legs and corresponding locking members are put in place, a suitable table top may be placed on the table structure 3500. In one specific implementation, the table top could include dowel pins extending downward from the bottom of the table top to align the table top in the proper position with respect to the structure 3500. One sample structure that could enhance the modular table include a tray 3600 as shown in FIGS. 36 and 37. The tray 3600 includes an open portion 3610 for holding things such as game pieces or poker chips, and further includes a drink holder 3620. The tray 3600 includes two extended portions 3630 and 3640 that allow the tray to be attached to one of the side members 3300 or 3400 without fasteners or other hardware. Two small slots may be placed in one of the side members 3300 and 3400. The extended portions 3630 and 3640 are then placed within the slots, as shown with the tray in phantom in FIG. 37. The tray is then rotated until the extended portions 3630 and 3640 rest on the inside surface of the side portion, as shown by the tray 3600 in solid lines in FIG. 37. Note the side member is shown in phantom in FIG. 37. This allows the tray 3600 to be easily attached and detached without tools or fasteners or other hardware.

Other enhancements to the modular furniture could also be made, and are within the scope of the disclosure herein. For example, one or more drawers could be installed in one or more of the side members 3300 and 3400 shown in FIGS. 33 and 34.

Figure 38:
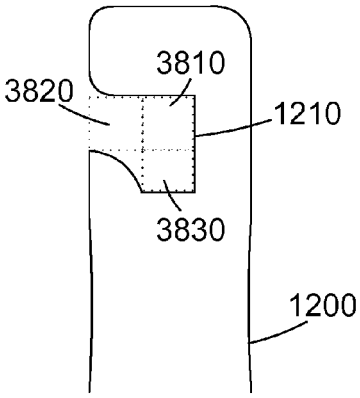
FIG. 38 is an enlarged side view of the leg 1200 shown in FIG. 12 to illustrate two legs for the L-shaped slot 1210.

The disclosure and claims herein refer to an L-shaped slot. This description is not meant to be limiting to a strict L shape, with one rectangular portion at a 90 degree angle with respect to a shorter rectangular portion. The term "L-shaped" as used in the disclosure and claims herein extends to any suitable configuration for a slot that has two portions or "legs" that have different angular orientations. For example, in FIG. 12, the second L-shaped slot 1220 has the shape of an L that is rounded at the corners, but is otherwise a traditional L-shape. The first L-shaped slot 1210, in contrast, is not in a traditional L-shape. An enlargement of the first L-shaped slot 1210 is shown in FIG. 38. What is meant by an L-shaped slot as used in the disclosure and claims herein is any slot that is not a square or rectangular slot that includes two distinct legs. Referring to FIG. 38, slot 1210 is shown with a common area 3810 that aligns with a first leg 3820 and a second leg 3830. The first and second legs are not part of the common area, and need not be rectangular, but could be a curved shape as well. This L-shaped slot thus provides two different orientations, one in line with the first leg, and one in line with the second leg. The different orientations for the two legs of the L-shaped slot is what allows the twist and lock motion disclosed herein. The term L-shaped slot as used in the disclosure and claims herein expressly extends to any slot that includes two legs in different orientations, regardless of the specific angle of those different orientations or specific shapes of the legs or slot.

Any suitable materials may be used to construct any or all of the structural members of the modular furniture disclosed and claimed herein. One suitable material is wood, but the modular furniture could be made with any suitable material, including by way of example plastic, metal, synthetic materials, corrugated pressboard, etc.

While the twist and lock motion illustrated in the figures and described herein allows twisting a member approximately 90 degrees, the disclosure and claims herein include angles more or less than 90 degrees. For example, the locking members could engage the legs and each other at an angle greater than 90 degrees, or less than 90 degrees.

Not all of the figures include all of the reference designators on other figures for the sake of clarity. For example, FIG. 2 shows many reference designators that are not shown on similar views in FIGS. 4, 8 and 10. Showing all of the reference designators on all views clutters the drawings and makes the drawings harder to understand. Unless otherwise noted, it is assumed that each view includes features in other views, even when those features are not labeled in a particular view.

While a modular chair and modular table are shown herein as examples of modular furniture that could include twist and lock members as described in detail above, the disclosure and claims herein expressly extend to any modular furniture or other structure that could be built using structural members that twist and lock together.

One skilled in the art will appreciate that many variations are possible within the scope of the claims. Thus, while the disclosure is particularly shown and described above, it will be understood by those skilled in the art that these and other changes in form and details may be made therein without departing from the spirit and scope of the claims.

The invention claimed is:

1. An article of manufacture comprising:

a plurality of first members that each includes a plurality of substantially rectangular first slots;

a plurality of second members that comprise a plurality of legs, wherein each of the plurality of second members includes a substantially L-shaped second slot comprising:

an opening to an edge of the second member defined by a gap between first and second boundaries of the opening;

a first substantially flat portion extending from the first boundary;

a second substantially flat portion extending substantially perpendicular to the first substantially flat portion;

a third substantially flat portion extending substantially perpendicular to the second substantially flat portion and substantially parallel to the first substantially flat portion;

a rounded portion connecting the third substantially flat portion to the second boundary of the opening; and wherein one of the plurality of the first members is connected to one of the plurality of second members without use of fasteners or other hardware by placing the opening in the substantially L-shaped second slot in the one second member in proximity to one of the plurality of substantially rectangular first slots in the one first member so the one second member has a first orientation with respect to the one first member, and twisting the one second member to a second orientation approximately 90 degrees rotated with respect to the first orientation to move a portion of the one second member into place within the one first slot in the one first member and to move a first portion of the one first member in proximity to the one first slot of the one first member into the substantially L-shaped second slot of the one second member.

2. The article of manufacture of claim 1 wherein the article of manufacture comprises a chair.

3. The article of manufacture of claim 1 wherein the article of manufacture comprises a table.

4. The article of manufacture of claim 1 wherein the first portion of the one first member is within a first leg of the L-shaped slot when the one first member has the first orientation with respect to the one second member, and wherein the one second member includes the first portion of the one first member within a second leg of the L-shaped slot when the one first member has the second orientation with respect to the one second member.

5. The article of manufacture of claim 1 wherein each leg further includes a second substantially L-shaped slot, wherein a first pair of the legs receive a first locking member in their respective second substantially L-shaped slots, and wherein a second pair of the legs receive a second locking member in their respective second substantially L-shaped slots.

6. The article of manufacture of claim 5 wherein the first and second locking members each comprising substantially L-shaped slots that receive a third locking member.

7. The article of manufacture of claim 6 further comprising a stop member that captivates the third locking member within the substantially L-shaped slots of the first and second locking members.

8. A method for assembling modular furniture, the method comprising the steps of:

providing a plurality of first members that each includes a plurality of substantially rectangular leg slots;

providing a plurality of leg members that each includes a substantially L-shaped second slot comprising:

an opening to an edge of the leg member defined by a gap between first and second boundaries of the opening;

a first substantially flat portion extending from the first boundary;

a second substantially flat portion extending substantially perpendicular to the first substantially flat portion;

a third substantially flat portion extending substantially perpendicular to the second substantially flat portion and substantially parallel to the first flat portion;

a rounded portion connecting the third substantially flat portion to the second boundary of the opening; and connecting one of the plurality of leg members to one of the plurality of first members without use of fasteners or other hardware by placing the opening in the substantially L-shaped second slot in the one leg member in proximity to the substantially rectangular leg slot in the one first member so the one leg member has a first orientation with respect to the one first member, and twisting the one leg member to a second orientation approximately 90 degrees rotated with respect to the substantially rectangular leg orientation to move a portion of the one leg member into place within the first slot in the one first member and to move a first portion of the one substantially rectangular leg member in proximity to the first slot of the one first member into the substantially L-shaped second slot of the one leg member.

9. The method of claim 8 wherein the modular furniture comprises a chair.

10. The method of claim 8 wherein the modular furniture comprises a table.

11. The method of claim 8 wherein the first portion of the one first member is within a first leg of the L-shaped slot when the one first member has the first orientation with respect to the one second member, and wherein the one second member includes the first portion of the one first member within a second leg of the L-shaped slot when the one first member has the second orientation with respect to the one second member.

12. The method of claim 8 further comprising the step of attaching each leg to one of the plurality of first members by performing the steps of:

placing the L-shaped slot of the leg in proximity to one of the substantially rectangular leg slots; and rotating the leg to captivate the one of the plurality of first members within the L-shaped slot of the leg.

13. The method of claim 12 wherein each leg further includes a second substantially L-shaped slot, and further comprising the steps of:

installing a first locking member in the second substantially L-shaped slots of a first pair of the legs; and installing a second locking member in the second substantially L-shaped slots of a second pair of the legs.

14. The method of claim 13 further comprising the step of installing a third locking member into third substantially L-shaped slots in the first and second locking members.

15. The method of claim 14 further comprising a stop member that captivates the third locking member within the substantially L-shaped slots of the first and second locking members.

16. A modular chair comprising:

a back member having a left upper slot, a right upper slot, a left lower slot, a right lower slot, and a seat slot;

a first side member having an upper slot that engages the left upper slot of the back member, having a lower slot that engages the left lower slot of the back member, and having an upper front slot and a lower front slot, and having two substantially rectangular leg slots;

a second side member having an upper slot that engages the right upper slot of the back member and having a lower slot that engages the right lower slot of the back member, and having an upper front slot and a lower front slot, and having two substantially rectangular leg slots;

a front member having two slots that engage the lower front slots in the first and second side members;

a seat member having a rear tab placed within the seat slot and having two slots that engage the upper front slots of the first and second side members, wherein the rear tab of the seat member comprises a hole behind the back member that receives a locking member that captivates the seat member within the seat slot, wherein the seat member captivates the front member within the lower front slots in the first and second side members;

four legs, each leg having a first substantially L-shaped slot, wherein a first pair of legs are attached to the first side member by placing the first substantially L-shaped slot of each of the first pair of legs in proximity to one of the leg slots in the first side member, and rotating each leg of the first pair of legs to captivate the first side member within the first substantially L-shaped slots of the first pair of legs, wherein a second pair of legs are attached to the second side member by placing the first substantially L-shaped slot of each of the second pair of legs in proximity to one of the leg slots in the second side member, and rotating each leg of the second pair of legs to captivate the second side member within the first substantially L-shaped slots of the second pair of legs, each leg further comprising a second substantially L-shaped slot;

a first locking member having first and second slots that engage the second substantially L-shaped slots of the first pair of legs and having a middle L-shaped slot;

a second locking member having first and second slots that engage the second substantially L-shaped slots of the second pair of legs and having a middle L-shaped slot;

a third locking member having first and second slots that engage the middle L-shaped slots of the first and second locking members; and a stop member that captivates the third locking member within the substantially L-shaped slots of the first and second locking members.

17. The modular chair of claim 16 further comprising:

a footrest dimensioned to slide within a portion of the first substantially L-shaped slots on the four legs that prevents the four legs from rotating to be disengaged; and a tray that pivotally attaches to a portion of the back member so the modular chair may be used as a high chair for a small child.

18. An article of manufacture comprising:

a plurality of first members that each includes a plurality of substantially rectangular first slot;

a plurality of leg members that each includes a substantially L-shaped second slots; and wherein each of the plurality of leg members is connected to one of the plurality of first members without use of fasteners or other hardware by placing an opening in the substantially L-shaped second slot in one of the plurality of leg members in proximity to one of the plurality of first slots in one of the plurality of first members so the one leg member has a first orientation with respect to the one first member, and twisting the one leg member to a second orientation approximately 90 degrees rotated with respect to the first orientation to move a portion of the one leg member into place within the first slot in the one first member and to move a portion of the one first member in proximity to the one first slot of the one first member into the substantially L-shaped second slot of the one leg member.

19. A method for assembling modular furniture, the method comprising the steps of:

providing two side members that each includes two substantially rectangular leg slots;

providing four leg members that each includes a substantially L-shaped second slot; and connecting one of the leg members to one of the two side members without use of fasteners or other hardware by placing an opening in the substantially L-shaped second slot in the one leg member in proximity to a first of the two substantially rectangular slot in the one side member so the one leg member has a first orientation with respect to the one side member, and twisting the one leg member to a second orientation approximately 90 degrees rotated with respect to the first orientation to move a portion of the one leg member into place within the first substantially rectangular slot in the one side member and to move a portion of the one side member in proximity to the first slot of the one side member into the substantially L-shaped second substantially rectangular slot of the one leg member.

* * * * *